United States Patent [19]

Stebegg et al.

[11] Patent Number: 4,501,463

[45] Date of Patent: Feb. 26, 1985

[54] CABLE TERMINAL ELEMENT

[75] Inventors: Josef Stebegg; Gerhart Becke, both of Erlangen, Fed. Rep. of Germany

[73] Assignee: Siemens Aktiengesellschaft, Berlin and Munich, Fed. Rep. of Germany

[21] Appl. No.: 449,583

[22] Filed: Dec. 14, 1982

[30] Foreign Application Priority Data

Dec. 21, 1981 [DE] Fed. Rep. of Germany ..... 3150568
May 27, 1982 [DE] Fed. Rep. of Germany ..... 3220006

[51] Int. Cl.[3] ..... H01R 13/38
[52] U.S. Cl. ..... 339/99 R
[58] Field of Search ..... 339/97 R, 97 P, 98, 339/99 R

[56] References Cited

U.S. PATENT DOCUMENTS 1,898,359 2/1933 Gilbert ..... 339/99 R
3,553,631 1/1971 Shlesinger, Jr. ..... 339/97 P

FOREIGN PATENT DOCUMENTS 2448111 9/1976 Fed. Rep. of Germany .

*Primary Examiner*—Joseph H. McGlynn
*Attorney, Agent, or Firm*—Kenyon & Kenyon

[57] ABSTRACT

A terminal element for connecting the conductors of an electrical cable to respective knife terminals of an electrical device comprises a cylindrical support body having an external screw thread and a plurality of axially extending, circumferentially spaced slots. The knife terminals each include a plate shaped flange disposed in a respective slot of the support body and provided with a notch for receiving and clamping a respective cable conductor. The terminal element further comprises a cap or sleeve with an internal screw thread having a height increasing within a few turns of the thread from zero at the entrance opening of the sleeve to the maximum conductor diameter. In a preferred embodiment, the notches in the end flanges of the knife terminals are spaced from and parallel to respective radii of the support body lying in the same transverse planes as the respective end flanges. The terminal element is assembled by placing the conductors of the cable in respective slots of the support body, the cable conductors initially overlying the notches of the knife terminal end flanges. Upon a screwing of the sleeve onto the support body, the internal screw thread of the sleeve contacts the cable conductors on opposite sides of the respective knife terminal end flange. The varying thread height of the internal screw thread results in a gradual shifting of the cable conductors radially inwardly into the respective knife terminal notches. The spacing of the notches laterally of respective radii of the support body serves to compensate tangential forces due to friction arising during the screwing of the sleeve onto the support body.

13 Claims, 7 Drawing Figures

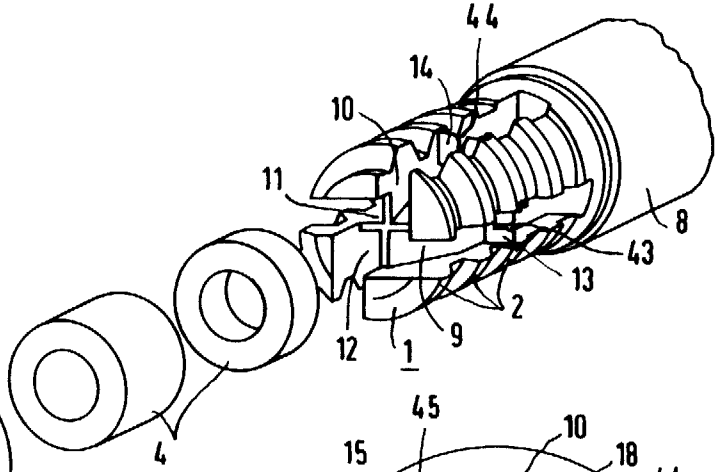
FIG 1
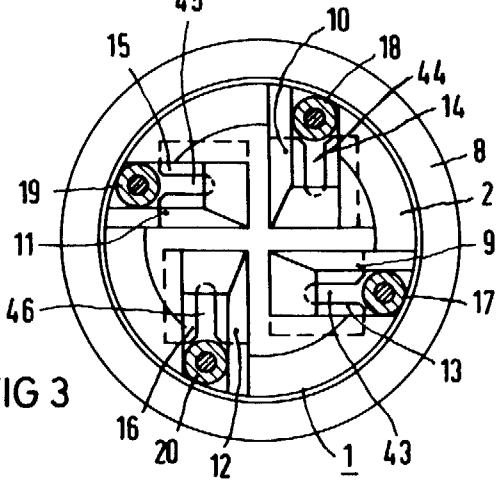
FIG 3
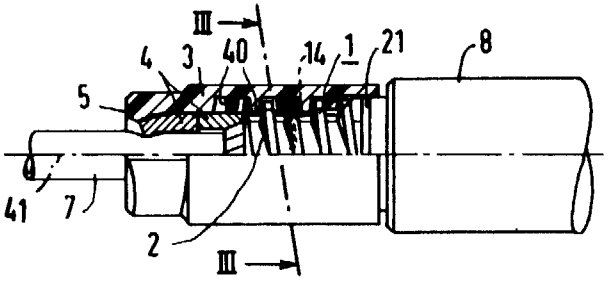
FIG 2
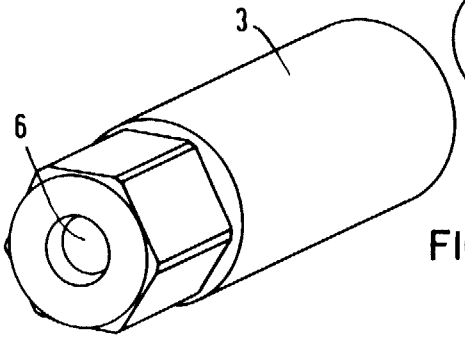

CABLE TERMINAL ELEMENT

FIELD OF THE INVENTION

The present invention relates to a cable terminal element for operatively connecting a multiconductor electric cable to an electric device having terminal electrodes in the form of knife terminals.

BACKGROUND OF THE INVENTION

Cable terminal elements serve to connect power and/or data transmission terminals of electrical equipment to the individual conductors of an electric cable in a detachable and electrically conducting manner.

Commercially available cable terminal elements of this kind are usually provided with screw terminals, into which the individual conductors of an electric cable must be inserted and clamped sequentially, as described in German patent document Ser. No. 2,448,111 (DE-AS No. 24 48 111). Especially in control cables with a small conductor cross section, such a connection operation is laborious and time-consuming. For this reason, so-called spring-force terminals have been introduced into commercial use, such terminals, however, being only qualifiedly suitable for control cables with flexible litz conductors. Screw terminals have also been replaced by so-called knife terminals, which have at their ends flanges with slots or notches into which individual cable conductors are pushed and clamped, which procedure is possible because of the elasticity of the conductor material. Although the labor expended in turning the clamping screws at every single terminal is elminated by using knife terminals, it is still necessary to introduce under pressure each individual conductor into a flange notch of a respective knife terminal. Because the forcing of the cable conductors into the knife terminal notches must be carried out uniformly, from both sides, special skill or a special tool is required, particularly in cables with a small conductor cross section.

SUMMARY OF THE INVENTION

The present invention attains the object of providing an improved cable connector or terminal element of the knife terminal type, wherein the connection formation time is reduced to a minimum without jeopardizing the operating reliability. In a cable terminal element according to the present invention, the cable conductors are inserted into respective knife terminal notches in a single operation. No special tools are required and the terminal element is shielded against the penetration of dust and moisture, while the conductors of the cable are protected from damage due to tensile stresses.

A cable terminal element according to the present invention comprises a support body, a cap or sleeve and camming means for automatically forcing the cable conductors into the knife terminals during a screwing of the cap onto the support body, this body being provided with an external screw thread which operatively engages an internal screw thread on the cap. The support body is formed with a plurality of axially extending, circumferentially spaced slots for receiving and housing the knife terminals (or at least the notched end flanges thereof) and cable conductors. At the onset of a screwing on operation, the cable conductors overlie the notches in the ends of the knife terminals, these knife terminal ends lying in at least one transverse plane extending perpendicularly to the axis of symmetry of the support body. The internal thread winding on the cap or sleeve has a height which increases gradually from a substantially zero value at an outer lip of the cap or sleeve to a maximum value equal to the maximum diameter of the cable conductors. Upon a screwing of the cap or sleeve onto the support body, the cable conductors are gradually forced into the knife terminal notches. The tangential forces arising from frictional contact with the internal thread winding may be blocked or dissipated by an intervening pressure member or may be accounted for by having the knife terminal notches laterally displaced from radial positions in the direction of the turning of the cap or sleeve.

A cable terminal element or connector assembly according to the present invention reduces the labor required to effect a satisfactory electrical connection. Moreover, seals and force transmitting means are employed which increase the durability of the assembled connector element.

BRIEF DESCRIPTION OF THE DRAWING

FIG. 1 is an exploded perspective view of a cable terminal element according to the present invention;

FIG. 2 is a side view, partially in cross section, of the cable terminal element of FIG. 1 in a fully connected state;

FIG. 3 is a cross-sectional view taken along plane III—III in FIG. 2, showing cable conductors lying on knife terminals;

SPECIFIC DESCRIPTION

Figure 4:
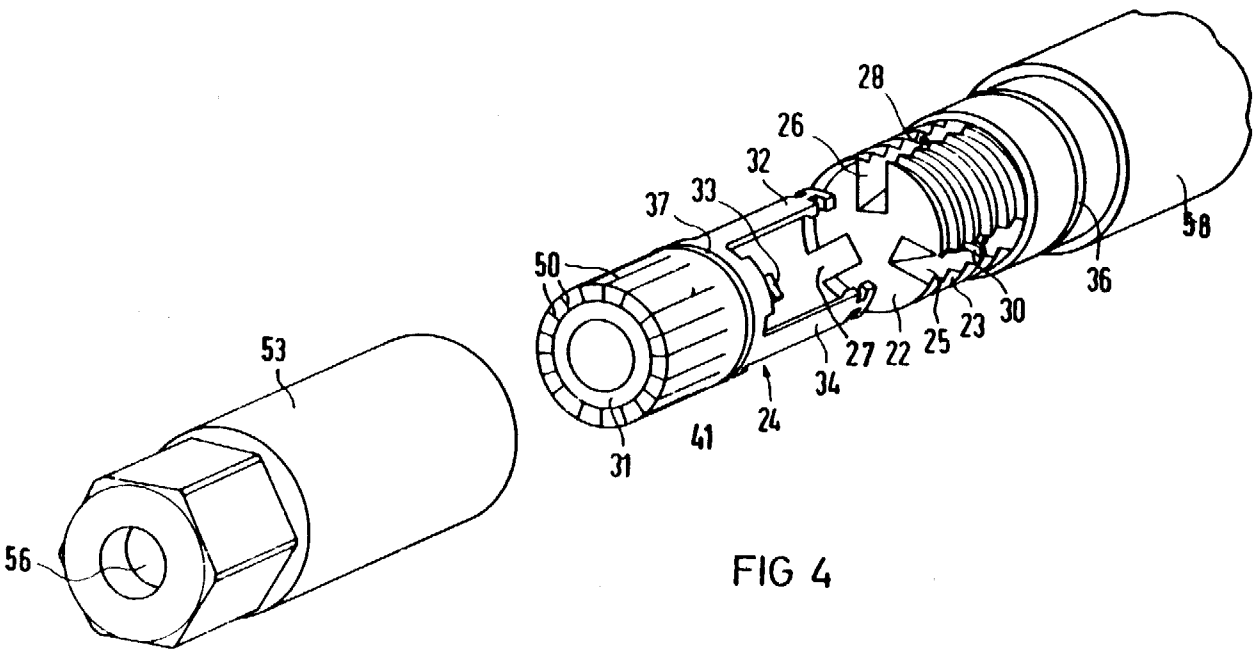
FIG. 4 is an exploded perspective view of another cable terminal element according to the present invention.

As illustrated in FIG. 1, a cable terminal element or connector according to the present invention comprises a cylindrical support body 1 with a rectangular external thread winding 2 and an outer jacket or screw cap 3 in the form of a sleeve. This sleeve is made of an insulating material such as a thermoplastic resin and has an internal winding 40 (see FIG. 2) having the same thread pitch as winding 2 for screwingly coacting therewith to attach body 1 to sleeve 3. Elastic rings or cylinders 4 are provided for relieving or transmitting tensile stresses as well as for implementing a moisture seal, as described in greater detail hereinafter with reference to FIG. 2. The length of sleeve 3 exceeds the length of body 1 by an amount at least equal to the combined lengths of rings 4, whereby the sleeve accomodates the rings 4 and completely covers body 1 in a fully connected or assembled condition of the cable terminal element of FIG. 1.

An inner side of sleeve 3 at an end thereof opposite body 1 in the exploded view of FIG. 1 is provided with an annular projection or bead 5 (see FIG. 2) which defines a circular opening 6 (see FIG. 1) transversed by a cable 7 (FIG. 2) in the assembled state of the connnector element. Support body 1, firmly attached in the assembled state to a knife terminal housing or holder 8 of an electrical device (not shown), is formed with circumferentially spaced slots or recesses 9, 10, 11 and 12 having a rectangular cross-section and extending axially from the end of body 1 which is inserted into sleeve 3. Each slot 9, 10, 11 and 12 has a first wall or surface which is coplanar with an axis of symmetry 41 of support body 1 and a second wall which is parallel to the first and spaced therefrom at a distance substantially equal to the width of a respective knife-terminal flange 13, 14, 15 or 16.

Flanges 13, 14, 15 and 16, operatively linked to respective data or power transmitting leads (not shown) of terminal housing 8, are substantially plate shaped and are provided with slots or notches 43, 44, 45 and 46 for clamping or pinching respective conductors of cable 7 upon receiving the same during a screwing of sleeve 3 onto support body 1. Upon the attachment of knife-terminal housing 8 to body 1, flanges 13, 14, 15 and 16 are disposed approximately midway between the ends of respective slots 9, 10, 11 and 12 of the support body, the flanges lying in planes extending substantially perpendicularly to axis 41 and being axially staggered with respect to one another by distances corresponding to the pitch of external thread winding 2. Each flange 13, 14, 15 and 16 is flanked by a pair of segments of winding 2 and extends into the respective slot 9, 10, 11 or 12 by an amount limited by the outside diameter of winding 2.

As illustrated in FIG. 3, notches 43, 44, 45 and 46 are formed with fanned-out or flared outer edges. Upon placement of conductors 17, 18, 19 and 20 of cable 7 into respective slots 9, 10, 11 and 12, the conductors engage and rest against the flared outer edges or lips of notches 43, 44, 45 and 46 (see FIG. 3). To implement the insertion of the cable conductors into the notches of knife terminal flanges 13, 14, 15 and 16, internal thread winding 40 is formed with a thread height which increases continuously from substantially zero at an end of sleeve 3 facing support body 1 in the exploded view of FIG. 1 to a maximum height at least equal to the diameter of the largest conductor 17, 18, 19 or 20, this maximum height being attained within a distance corresponding to a few turns of sleeve 3.

The force $P_d$ exerted on each conductor, for example conductor 18 in FIG. 3, to shift it into the respective knife terminal notch (44 in FIG. 3) is applied to the conductor by internal thread winding 40 at points before and behind the notch. This force $P_d$ is composed of two separate vector components, $P_r$ and $P_t$. The screwing of sleeve 3 onto support body 1 produces tangential force $P_t$ due to friction as well as radial force $P_r$ perpendicular thereto. Resultant force $P_d$ points at least approximately in the direction of notch 44, thereby ensuring that cable conductor 18 slides into notch 44 rather than being sheared off at the flared outer edge thereof. It is to be noted that each notch 43, 44, 45 and 46 extends parallel to and at a predetermined distance from a respective radius (not shown) of support body 1 lying in the same transverse plane as the notch, the notches being shifted in the direction of turning of sleeve 3.

As illutrated in FIG. 2, an outermost ring of the pair of rings 4 is forced radially inwardly by bead 5, in an assembled state of the cable terminal element of FIG. 1, to form with cable 7 a moisture tight lock fit which transmits tensile forces. The outer ring of pair 4 thus coacts with cable 7 and bead 5 to protect the cable connection against the penetration of dust and moisture. At the end of sleeve 3 opposite bead 5, the sleeve forms a moisture and dust seal with an O-ring 21 which is seated in an annular groove (not enumerated) in support body 1.

To facilitate the crossing over of cable conductors 17, 18, 19 and 20 between cable 7 and slots 9, 10, 11 and 12, the partitions between the cable conductors are axially offset by a corresponding amount relative to the end face of the support body 1 on the insertion side, an empty space being thus produced in the interior of the support body for crossed-over installation of the cable conductors. The end of cable jacket or sleeve 3 is in these circumstances aligned approximately with the end face of the support body.

It is clear that slots 9, 10, 11 and 12 may be adapted to the desired number of conductors. Moreover, the cable terminal element according to the present invention may take the form of cable sleeve for joining two cable ends or a "T" for joining two cables to an electrical device.

It is to be remarked that a rectangular screw thread profile has been found practical. The use of other thread profiles in particular applications would not represent a departure from the principles of the present invention.

The cable terminal element shown in FIG. 4 comprises a cylindrical support body 22 with an external thread winding 23 (which may be a standard metric thread, e.g. M14), a sleeve-like screw cap 53 with a corresponding internal thread winding 47 (see FIGS. 5 and 7) for screwing the cap onto the support body 22, and a pressure member 24 of elastic material. Screw cap 53 has the form of a sleeve open on one side and partially closed on an opposite side and is designed to cover support body 22 completely in the assembled condition of the cable terminal element while extending axially beyond the support body on the insertion side for accommodating pressure member 24. Like sleeve 3, cap or sleeve 53 is provided with a bead 55 (see FIG. 5) which closes it off except for an opening 56 for a cable 57 (FIGS. 2 and 5).

Support body 22 is firmly connected at one end to an electrical device via a knife terminal holder 58. In addition, the support body has axially extending slots or recesses 25, 26 and 27 of approximately rectangular cross section, which are angularly equispaced about the periphery or circumference of support body 22 for receiving knife terminals 28, 29 and 30 (terminal 29 not being visible in the drawing).

Figure 5:
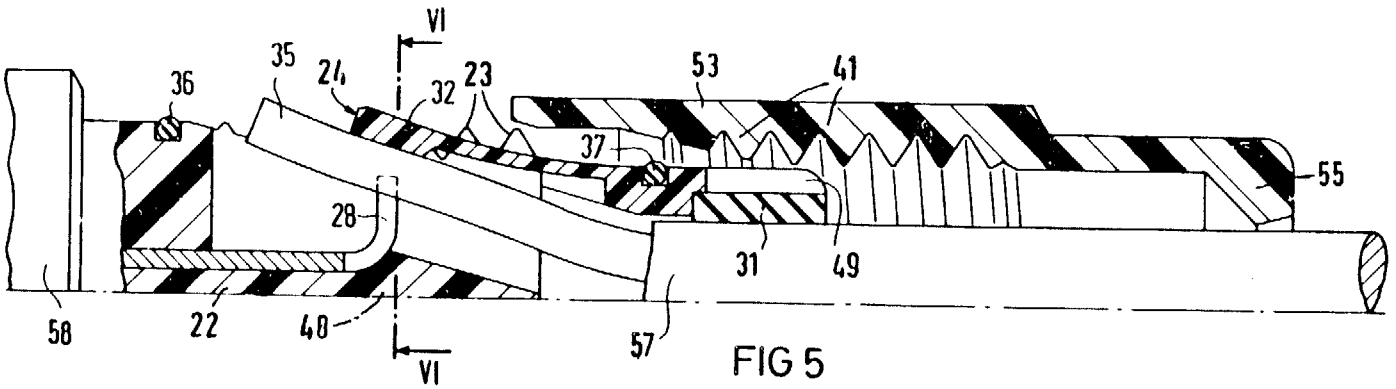
FIG. 5 is a partially cross-sectional side view of the cable terminal element of FIG. 4 at an intermediate stage of a connecting process.
Figure 6:
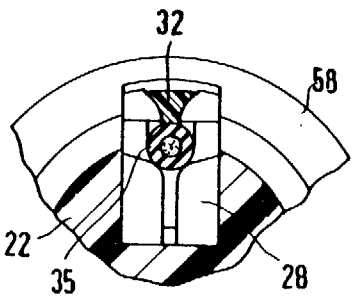
FIG. 6 is a partial cross-sectional view taken along plane VI—VI in FIG. 5, showing cable conductors lying on knife terminals.
Figure 7:
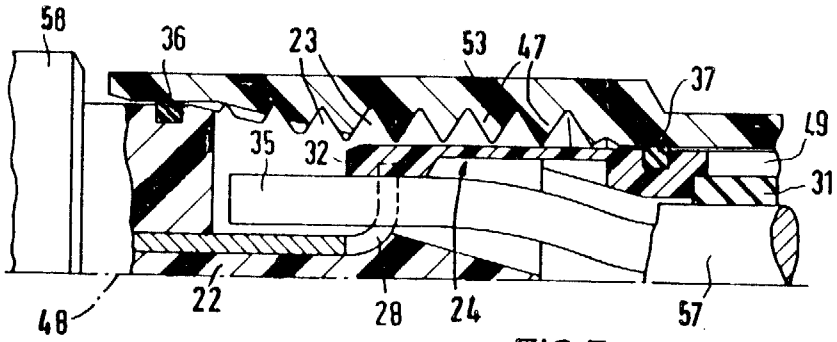
FIG. 7 is a partially cross-sectional side view of the cable terminal element of FIGS. 4 and 5 in a fully connected state.

As illustrated in FIG. 5, knife terminals 28, 29 and 30 are disposed in part in at least one transverse plane (not represented) extending perpendicularly to an axis of symmetry 48 of support body 22 substantially midway between the ends of slots 25, 26 and 27. Knife terminals 28, 29 and 30 project radially outwardly into slots 26, 27 and 25, respectively, to the base of external thread winding 23. Pressure member 24 has a ring-shaped portion 49 with an outside diameter corresponding approximately to the inside diameter of screw cap 53 and an inside diameter corresponding approximately to the outside diameter of cable 57. At an end facing away from the support body 22 in the exploded view of FIG. 4, the pressure member is feathered, i.e., is provided with a multiplicity of axial cuts or slots 50, whereby, upon a screwing of cap 53 onto support body 22, ring shaped portion 49 is compressed to clamp an elastic annular member 31 to cable 57 to stress-relieve the same. The inside wall or surface of cap 53 is, at least in part, conically tapered inwardly toward cable entrance 56 (e.g. in the area of bead 55, as illustrated in FIG. 5) to an extent sufficient to clamp annular member 31 to cable 57. Toward support body 22 in FIG. 4, pressure member 24 is provided with radially elastic fingers 32, 33 and 34 of such a length that they are located, if pressure member 24 rests against the end face of the support body 1, over knife terminals 28, 29 and 30, the ends of the fingers 32, 33 and 34 being shaped to engage the conductors (e.g. conductor 35 in FIGS. 5 and 7) of cable 57 but not knife terminals 28, 29 and 30. For this purpose, internal thread winding 47 of screw cap 53 has a height which gradually increases within a few turns of winding 47 from a zero value at an end of cap 53 opposite bead 55 to a maximum height equal to the maximum diameter of the conductors (e.g. 35) of cable 57. The variation in the height of thread winding 47 gradually shifts the conductors of cable 57 into respective knife terminals 28, 29 and 30 during the first few turns of cap 53 onto body 22. Internal screw thread 47 acts as a cam which transforms the rotary motion of cap 53 into a radially inward shift of the cable conductors, fingers 32, 33 and 34 serving to transmit radial forces and dissipate or block tangential forces due to friction. FIG. 5 and 7 represent beginning and ending stages of an attachment operation.

As shown in FIG. 7, cap 53 engages in a fully assembled state of the cable terminal element an elastic O-ring 36 seated in an annular groove on support body 22. Another O-ring 37 seated in an annular groove in pressure member 24 engages cap 53 in the region of bead 55. O-rings 36 and 37 coact with cap 53 to seal the cable terminal element of FIGS. 4–7 against the penetration of dust and moisture.

Pressure member 24 may be made from inexpensive thermoplastic resin. In simultaneously serves for traction relief of cable 57 and for sealing the cable terminal element on the cable side. Pressure member 24 facilitates the insertion of conductors of cable 57 into knife terminals 28, 29 and 30, thereby ensuring the formation a high quality electrical contact.

What is claimed is:

1. A cable terminal element for operatively connecting an electrical cable having a plurality of conductors to an electrical device having a like plurality of terminal electrodes in the form of knife terminals for forming detachable connections to respective conductors of said cable, each of said knife terminals having at an end a substantially plate shaped flange provided with a notch for receiving and clamping a respective conductor of said cable during a connecting operation, said element comprising:

a substantially cylindrical support body having an axis of symmetry and provided with an external thread winding and a plurality of axially extending, circumferentially spaced slots equal in number to said knife terminals, each of said flanges being disposed, in a fully connected state of the terminal element, in a respective one of said slots and in a plane extending substantially perpendicularly to said axis;

an outer jacket in the form of a sleeve provided with an internal thread winding having the same thread pitch as said external thread winding for coacting therewith to screw said sleeve onto said body; and camming means actuatable by said sleeve for shifting said conductors radially inwardly in said slots during a screwing of said sleeve onto said body, whereby each of said conductors is forced into the notch of a respective flange of said knife terminals.

2. The element defined in claim 1 wherein said sleeve is provided with an annular projection on an inner side of said sleeve at one end thereof, further comprising an elastic ring clamped to said cable by said projection in the fully connected state of the terminal element to form a moisture tight, force transmitting lock fit between said cable and said sleeve.

3. The element defined in claim 1 wherein partitions between said conductors are axially offset in the direction of said knife terminals by an amount sufficient to create an empty space for accommodating a crossing over of said conductors between said cable and said body.

4. The element defined in claim 1 wherein each flange of said knife terminals is flanked in a circumferential direction, in the fully connected state of the terminal element, by segments of said external thread winding, the flanges of said knife terminals being axially staggered with respect to each other by distances corresponding to the pitch of said external thread winding, the flanges of said knife terminals extending radially outwardly at most to an outer diameter of said external thread winding.

5. The element defined in claim 4 wherein said slots extend substantially the length of said body, the flange of each of said knife terminals being disposed, in the fully connected state of the terminal element, substantially midway between the ends of a respective slot of said body.

6. The element defined in claim 1 wherein each notch in the flanges of said knife terminals is disposed, in the fully connected state of the terminal element, substantially parallel to and ata predetermined distance from a respective radius of said body lying in the transverse plane occupied by such notch, whereby each of said conductors is pushed, during a screwing of said sleeve onto said body, into a respective notch in the flanges of said knife terminals by a respective force having a radial component and a tangential component, the tangential component arising from friction between the respective conductor of said cable and said internal thread winding.

7. The element defined in claim 6 wherein each of said slots is rectangular in cross-section and has a first wall coplanar with said axis and a second wall disposed parallel to said first wall and at a distance therefrom substantially equal the width of said flanges.

8. The element defined in claim 1 wherein said camming means includes a pressure member inserted in said sleeve, said member having a substantially ring shaped portion surrounding said cable and a plurality of radially elastic fingers equal in number to said knife terminals and extending axially from said ring shaped portion, said fingers being circumferentially spaced from each other at angles equal to the angles between said slots, said fingers at least partially overlying respective conductors of said cable upon assembly of said element, whereby said fingers force said conductors into notches of respective knife terminals upon a screwing of said sleeve onto said body.

9. The element defined in claim 8 wherein said sleeve is provided with an annular projection on an inner side of said sleeve at one end thereof, further comprising an elastic ring inserted in said sleeve between said ring shaped portion and said cable, said elastic ring being clamped to said cable in the fully connected state of the terminal element by a force applied by said proection via said ring shaped portion, whereby a moisture-tight, force transmitting lock fit is formed between said cable and said sleeve.

10. The element defined in claim 9 wherein said ring shaped portion is provided at an end opposite said fingers with a multiplicity of longitudinal slots.

11. The element defined in claim 2 or 9 wherein said body is provided on an outer surface at an end opposite said cable in the fully connected state of the terminal element with an elastic O-ring, said sleeve entirely covering said body and forming a moisture-tight engagement with said O-ring in the fully connected state of the terminal element.

12. The element defined in claim 1 or 8 wherein said camming means includes said internal thread winding, said internal thread winding having a variable thread height continuously increasing from substantially zero at an end of said sleeve to a height at least equal the diameter of the largest of said conductors.

13. The element defined in claim 12 wherein the height of said internal thread winding varies over a part of the length of said sleeve substantially equal to the distance of the flanges of said knife terminals from the end of said body opposite said cable in the fully connected state of the terminal element.

* * * * *